US011357332B2

(12) United States Patent
Chalfin et al.

(10) Patent No.: US 11,357,332 B2
(45) Date of Patent: Jun. 14, 2022

(54) FURNITURE WITH INTEGRATED ACOUSTICAL SYSTEM

(71) Applicant: SAMUELSON GROUP INC., Paterson, NJ (US)

(72) Inventors: Lawrence Mark Chalfin, Wayne, NJ (US); Michael Adam Chalfin, Wayne, NJ (US)

(73) Assignee: SAMUELSON GROUP INC., Paterson, NJ (US)

( * ) Notice: Subject to any disclaimer, the term of this patent is extended or adjusted under 35 U.S.C. 154(b) by 0 days.

(21) Appl. No.: 17/399,401

(22) Filed: Aug. 11, 2021

(65) Prior Publication Data

US 2022/0047084 A1 Feb. 17, 2022

Related U.S. Application Data

(60) Provisional application No. 63/064,069, filed on Aug. 11, 2020.

(51) Int. Cl.

| | |
|---|---|
| ***A47C 7/72*** | (2006.01) |
| ***A47C 5/14*** | (2006.01) |
| ***H04R 7/04*** | (2006.01) |
| ***H04R 1/02*** | (2006.01) |
| ***H04R 1/28*** | (2006.01) |
| ***H04R 5/02*** | (2006.01) |

(52) U.S. Cl.

CPC ..... *A47C 7/727* (2018.08); *A47C 7/72* (2013.01); *H04R 1/025* (2013.01); *H04R 1/2834* (2013.01); *H04R 5/02* (2013.01); *H04R 5/023* (2013.01); *H04R 7/045* (2013.01); *A47C 5/14* (2013.01); *H04R 2201/02* (2013.01)

(58) Field of Classification Search

CPC .. A47C 7/72; A47C 7/727; A47C 5/14; H04R 2201/02

USPC ..... 297/217.4, 452.23–452.26, 297/452.29–452.36; 381/152, 333, 382

See application file for complete search history.

(56) References Cited

U.S. PATENT DOCUMENTS 4,979,777 A * 12/1990 Takada ..... B60N 2/2839 297/250.1
5,143,055 A * 9/1992 Eakin ..... A61H 23/0236 297/217.4

(Continued)

FOREIGN PATENT DOCUMENTS

CN 111918181 A * 11/2020 ..... H04R 7/045
DE 102011084168 A1 * 4/2013 ..... H04R 31/003

(Continued)

OTHER PUBLICATIONS 3 page PDF of screen shot and transcript of a YouTube video title Hot to Turn Anything into a Speaker, published Jun. 10, 2106 at https://www.youtube.com/watch?v=ZozOkUHijDI. (Year: 2016).*

(Continued)

*Primary Examiner* — Robert Canfield
(74) *Attorney, Agent, or Firm* — Riverside Law LLP

(57) ABSTRACT

An article of furniture includes a cushioned seating portion, a rigid panel configured adjacent to the cushioned seating portion, a first group of exciters configured on a surface of the rigid panel, and a controller communicatively coupled to the first and second plurality of exciters.

12 Claims, 3 Drawing Sheets

(56) References Cited

U.S. PATENT DOCUMENTS 5,314,403 A * 5/1994 Shaw ..... A61H 23/0236 297/217.1
5,368,359 A * 11/1994 Eakin ..... A61H 23/0236 297/184.14
5,387,026 A * 2/1995 Matsuhashi ..... B60N 2/879 297/217.4
5,442,710 A * 8/1995 Komatsu ..... A61H 1/005 381/162
5,482,352 A * 1/1996 Leal ..... B60N 2/286 297/217.4
5,838,808 A * 11/1998 Prosser ..... H04R 5/023 381/388
6,320,967 B1 * 11/2001 Azima ..... B42D 15/022 381/152
6,585,515 B1 * 7/2003 Roy ..... G09B 9/00 434/55
7,553,288 B2 * 6/2009 Cohen ..... A61H 23/0236 181/144
8,007,043 B1 * 8/2011 Vuong ..... B60N 2/2839 297/250.1
8,172,331 B2 * 5/2012 Cramer ..... A47C 15/004 297/446.2
8,857,907 B2 * 10/2014 Nagamitsu ..... A61H 1/003 297/260.2
10,165,369 B1 * 12/2018 Escobar ..... H04R 7/045
10,313,795 B1 * 6/2019 Escobar ..... H04R 1/26
10,979,241 B2 * 4/2021 Nelson ..... A47C 7/723
2002/0017813 A1 * 2/2002 Greene ..... B60N 2/793 297/411.36
2003/0053642 A1 * 3/2003 Bank ..... H04R 7/045 381/152
2003/0081799 A1 * 5/2003 Klasco ..... H04R 7/045 381/152
2005/0184607 A1 * 8/2005 Nakajima ..... H04R 9/06 310/81
2008/0100108 A1 * 5/2008 Fullmer ..... A47C 7/72 297/217.4
2010/0314921 A1 * 12/2010 Kim ..... H04R 5/023 297/217.4
2011/0278890 A1 * 11/2011 Takahashi ..... A47C 31/11 297/284.1
2019/0289398 A1 * 9/2019 Escobar ..... H04R 1/025
2020/0054518 A1 * 2/2020 Noso ..... A61H 23/02

FOREIGN PATENT DOCUMENTS

DE 102021002796 A1 * 7/2021 ..... B60R 16/037
EP 2003926 A1 * 12/2008 ..... H04R 5/02
WO WO-9709844 A1 * 3/1997 ..... H04R 1/025
WO WO-2015118217 A1 * 8/2015 ..... H04R 5/02
WO WO-2018218681 A1 * 12/2018 ..... H04R 1/28

OTHER PUBLICATIONS 3 page PDF of screenshots of Amazing Cardboard Speakers | Dayton High Efficiency Flux Exciter Review | Ultimate Gaming Chair; YouTube video published at https://www.youtube.com/watch?v=SG-z8j9XfUw on Apr. 11, 2015. (Year: 2015).*

* cited by examiner

FURNITURE WITH INTEGRATED ACOUSTICAL SYSTEM

CROSS-REFERENCE TO RELATED APPLICATIONS

This application claims priority to U.S. provisional application No. 63/064,069 filed on Aug. 11, 2020 incorporated herein by reference in its entirety.

BACKGROUND OF THE INVENTION

Sound waves discernable to the human ear (typically 20 Hz-20,000 Hz) are created by the fluctuation of air pressure caused by the movement or vibration of an object. This movement or vibration transmits kinetic energy to the air particles surrounding it, resulting in the generation of a sound wave. The frequency of the sound wave determines the audible sound created, with slower vibrations yielding low-frequency sounds and faster vibrations yielding high-frequency sounds.

A conventional speaker generates an audible sound by converting electrical signals into acoustical energy. Movement of the speaker increases and decreases the air pressure in front of it, which creates sound waves. The conical portion of the speaker (typically referred to as the cone) is the primary dynamic component of the speaker. Larger cones have more surface area and move more mass, thereby moving more air and producing a louder acoustical energy or acoustical sound. Other components well known are used as part of a conventional speaker structure for producing sound, including a magnet structure, voice coil, rear suspension, metal frame, front suspension and a dust cover. These conventional speaker structures are typically mounted at the face of a hollow box and are very directional in nature, the direction typically defined along an axis extending out from a center of the cone.

Conventional speakers have been integrated into various objects, including furniture. For example, seating can incorporate built-in speakers for purposes of providing a user sitting in this seating with a more immersive experience. For example, when watching a movie, gaming or enjoying virtual reality amusement experience, it's often desirable to incorporate speakers into the seating to provide audio unique to that user, or otherwise provide audio as part of a more immersive experience. Further, furniture often aims to provide a synergistic storage function, and incorporating speakers into the empty voids of furniture alleviates the need for the user to incorporate speakers elsewhere, taking-up valuable space.

However, conventional speakers integrated into furniture has several drawbacks. First, since conventional speakers are very directional, the furniture requires a void that matches the best direction for the speaker to reach the user. If the position of the void is not ideal, the directional nature of the resulting sound could provide a sub-optimal acoustical affect. Second, since conventional speakers are often mounted in a box, the furniture piece may require some minimum void dimension that it may not ordinarily have, resulting in a structural change to the furniture piece that could affect it's structural integrity, appearance or function. Third, since conventional speakers are very directional, even when placed at the optimal position, furniture systems with integrated conventional speakers do not Thus, what is needed in the art is an improved system and method for integrating an acoustical system into furniture.

SUMMARY OF THE INVENTION

An article of furniture comprising a cushioned seating portion; a rigid panel configured adjacent to the cushioned seating portion; a first plurality of exciters configured on a surface of the rigid panel; a controller communicatively coupled to the first and second plurality of exciters. In one embodiment, the rigid panel wraps around a back portion the cushioned seating portion and at least partially along each side of the cushioned seating portion. In one embodiment, the cushioned seating portion is configured to sit on a base connected to the rigid panel, and the article of furniture further comprises a void separating a majority of the rigid panel from the base. In one embodiment, the rigid panel is configured to provide an arm rest, back rest and head rest. In one embodiment, the cushioned seating portion is at least partially housed by the rigid panel. In one embodiment, at least two of the first plurality of exciters configured as an opposing pair. In one embodiment, the article of furniture includes a second plurality of exciters configured on a surface of the rigid panel, at least two of the second plurality of exciters configured as an opposing pair. In one embodiment, a first side of the rigid panel comprises a first concave profile portion configured between a first and second convex profile portion, and a second side of the rigid panel comprising a second concave profile portion configured between a third and fourth convex profile portion. In one embodiment, the first plurality of exciters comprises a first exciter configured at the first concave profile portion and a second exciter configured at the first convex profile portion. In one embodiment, a second plurality of exciters comprises a third exciter configured at the second concave profile portion and a fourth exciter configured at the third convex profile portion. In one embodiment, the first plurality of exciters are configured as opposing pairs on the rigid panel and spaced apart to produce an evenly distributed resonation. In one embodiment, the first plurality of exciters includes four exciters configured as opposing pairs on the rigid panel. In one embodiment, the first plurality of exciters includes six exciters configured as opposing pairs on the rigid panel. In one embodiment, the first plurality of exciters includes eight exciters configured as opposing pairs on the rigid panel. In one embodiment, the rigid panel comprises an engineered rigid structure. In one embodiment, the rigid panel comprises laminated wood or plywood. In one embodiment, the article of furniture is a chair. In one embodiment, the article of furniture is configured to seat at least one person.

BRIEF DESCRIPTION OF THE DRAWINGS

The foregoing purposes and features, as well as other purposes and features, will become apparent with reference to the description and accompanying figures below, which are included to provide an understanding of the invention and constitute a part of the specification, in which like numerals represent like elements, and in which.

DETAILED DESCRIPTION OF THE INVENTION

Figure 1:
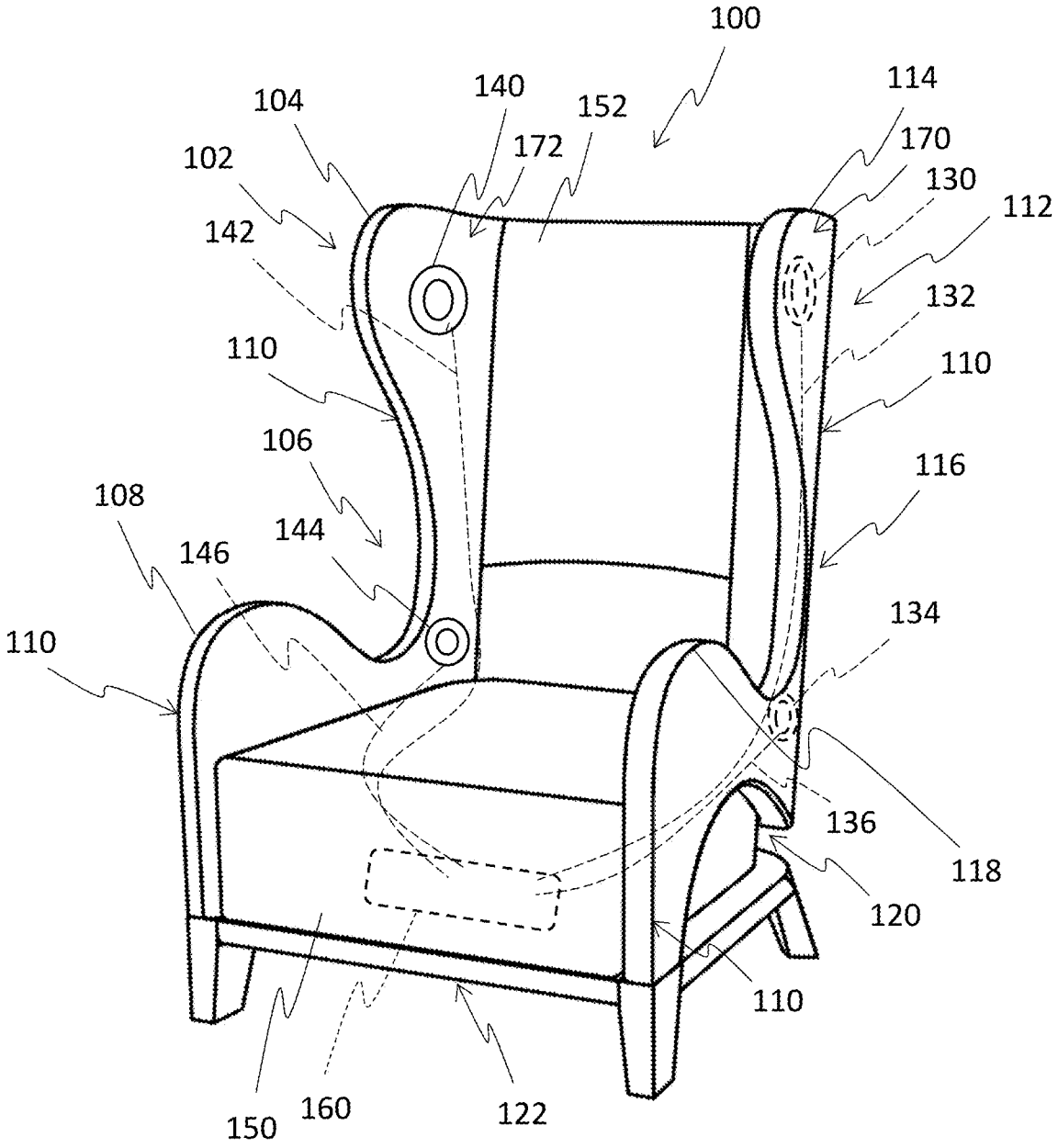
FIG. 1 is a perspective view of an article of furniture having an integrated acoustical system according to one embodiment.

It is to be understood that the figures and descriptions of the present invention have been simplified to illustrate elements that are relevant for a more clear comprehension of the present invention, while eliminating, for the purpose of clarity, many other elements found in systems and methods of producing furniture or acoustical systems. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, and ±0.1% from the specified value, as such variations are appropriate.

Ranges: throughout this disclosure, various aspects of the invention can be presented in a range format. It should be understood that the description in range format is merely for convenience and brevity and should not be construed as an inflexible limitation on the scope of the invention. Where appropriate, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Referring now in detail to the drawings, in which like reference numerals indicate like parts or elements throughout the several views, in various embodiments, presented herein is an article of furniture having an integrated acoustical system.

Embodiments of the articles of furniture described herein use an exciter to vibrate the surface it is fastened to in order to create sound waves. The embodiments provide an advantage over conventional cone diaphragm designs since the embodiments use movement of rigid portions of the furniture itself to produce sound. Embodiments may be engineered with laminated wood or plywood structures instead of traditional solid wood that a chair frame would be made from. Building the chairs this way enables vibration of the structure and production of an even acoustic. Thus, if the article of furniture is a chair, users sitting in the chair are sitting in the speaker itself. Sound is produced by the chair as opposed to from a location on the chair. Four or more exciters per chair are used to get an evenly distributed resonation.

Figure 2:
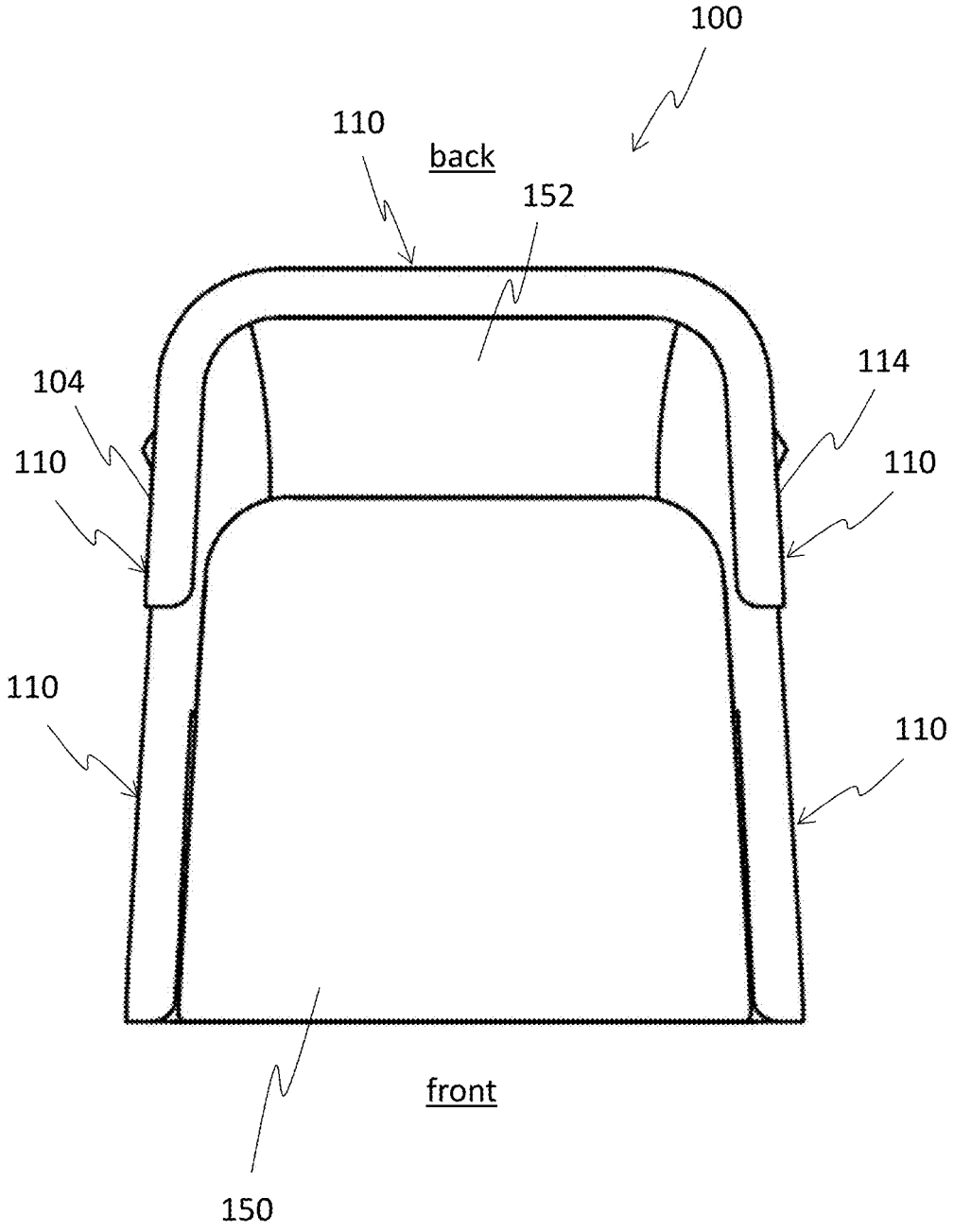
FIG. 2 is a top-down view of the article of furniture of FIG. 1, showing the solid panel wrapping along the back.

With reference now to FIGS. 1 and 2, an article of furniture 100 (in this case a chair) is shown according to one embodiment. The article of furniture 100 includes a cushioned seating portion 150 and a back 152. The cushioned portions can be similar to those known in the art, such as upholstery using furniture grade flexible fabric surrounding by a cushioning material such as a polyester fill (see e.g. FIGS. 3A and 3B). A rigid panel 110 wraps around the back of the cushioned seating portion 150 and partially up each side. Thus, a first side 102 of the rigid panel 110 is configured on a left side of the cushioned seating portion 150, and a second side 112 of the rigid panel 110 is configured on a right side of the cushioned seating portion 150, opposing each other with symmetrical geometries. The rigid panel 110 can turn along curved bends (instead of angled corners) for acoustical continuity, furniture strength and integrity, and for avoiding a vibration interference. In one embodiment, the symmetrical geometry can include one or more exciters along a central axis, and opposing pairs on opposite sides of the central axis. As will be appreciated by those having ordinary skill in the art, various configurations are possible without departing from the spirit of the invention. In the instant embodiment, first and second exciters 140, 144 are configured on a surface 172 of the first side 102, while third and fourth exciters 130, 134 are configured on a surface 170 of the second side 112. The exterior surface 170 is opposite the interior surface 172, and exciters can be arranged in either surface, or in a recess or space of the rigid panel layer. A controller 160 is communicatively coupled to the exciters 130, 134, 140, 144 via wires 132, 136, 142, 146, but can also communicate with the controller 160 via a wireless connection. The controller can communicate with other devices such as mobile devices via wired or wireless protocols known in the art such as Bluetooth. The cushioned seating portion 150 is configured to sit on a base 122 connected to the rigid panel 110, and a void 120 separates a majority of the rigid panel 110 from the base 122, advantageously providing superior acoustics since the rigid panel 110 is isolated from the base and other factors transmitted from flooring properties that may negatively alter acoustical quality. The void 120 can in certain embodiments represent separation along a vast majority of the base, including but not limited to at least 85%, 90%, and 95% separation. The void 120 can include an entire back side separation and can further include a connected portion limited to front-right and front-left corners. Exciters can optionally be added to the base in certain embodiment.

The first side 102 includes a first concave profile portion 106 configured between a first and second convex profile portions 104, 108. The second side includes a second concave profile portion 116 configured between a third and fourth convex profile portion 114, 118. This allows space to fix the exciter to the rigid panel layer while also providing an optimal acoustic environment for the user sitting in the chair. Thus, a first exciter is configured at the first concave profile portion and a second exciter configured at the first convex profile portion. A third exciter is configured at the second concave profile portion and a fourth exciter configured at the third convex profile portion. The first and second group of exciters can be configured as opposing pairs on the first and second side and spaced apart to produce an evenly distributed resonation on the rigid panel. The first and second group of exciters can include a total of four, six, eight or more exciters configured as opposing pairs. For rigidity, the rigid panel can be an engineered rigid structure such as laminated wood or plywood. The rigid panel layer can be a contiguous structure from top to bottom so that the user is substantially immersed within the sound wave produced by the rigid portion from head to toe as the article of furniture effectively becomes the speaker, which advantageously provides a uniform and high quality immersive acoustical experience.

As would be appreciated by those having ordinary skill in the art, the article of furniture can be a chair designed to seat one, two, three or more people. The embodiments described herein can be applied to other types of furniture, such as a chaise lounge, ottoman, bench, recliner or couch, or other types of single or multiple-seat furniture.

Experimental Examples

The invention is now described with reference to the following Examples. These Examples are provided for the purpose of illustration only and the invention should in no way be construed as being limited to these Examples, but rather should be construed to encompass any and all variations which become evident as a result of the teaching provided herein.

Without further description, it is believed that one of ordinary skill in the art can, using the preceding description and the following illustrative examples, make and utilize the present invention and practice the claimed methods. The following working examples therefore, specifically point out the preferred embodiments of the present invention, and are not to be construed as limiting in any way the remainder of the disclosure.

Figure 3A:
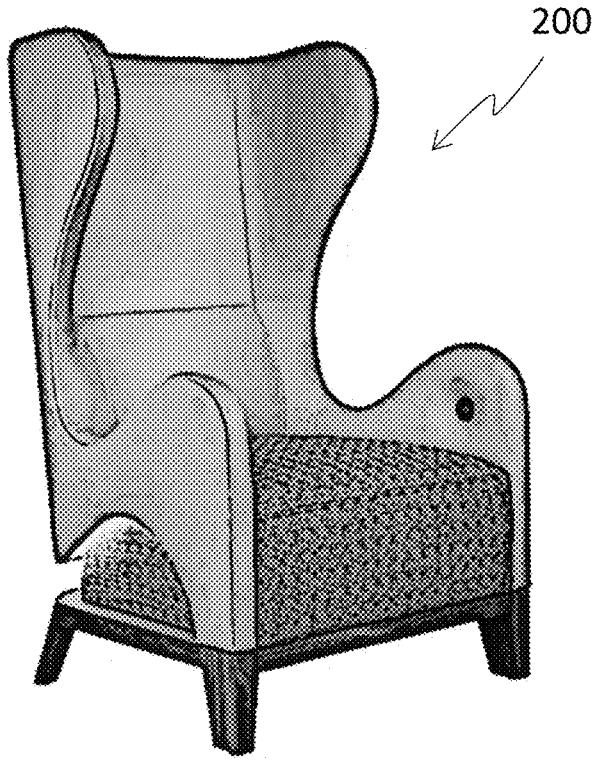
FIG. 3A is a perspective view and FIG. 3B is an alternate perspective view of an article of furniture according to one experimental embodiment.
Figure 3B:
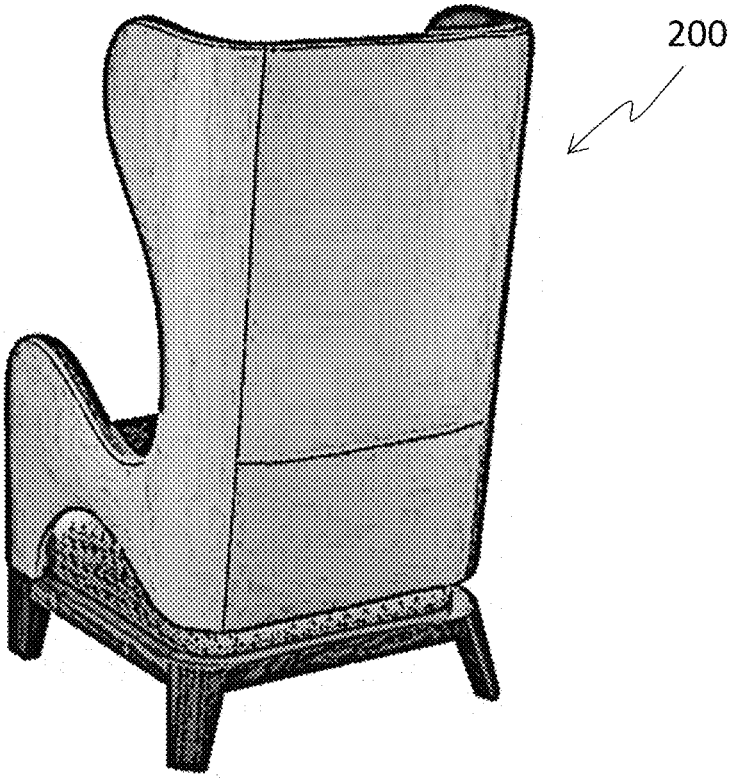

With reference now to FIGS. 3A and 3B, a prototype example 200 of an article of furniture (in this case a chair) is shown according to one embodiment. The prototype 200 is shown upholstered with a furniture grade flexible fabric surrounded by a cushioning material such as a polyester fill covering the rigid panel, which like FIGS. 1 and 2 wraps around the back of the cushioned seating portion 150 and partially up each side. Exciters such as first, second, third and fourth exciters as described in FIGS. 1 and 2 are configured on a surface of the rigid panel, but hidden behind the cushion and upholstery. Advantageously, since the sound source is not directional as in the case of conical speakers, the acoustics are generated with uniform resonance and speakers need not be exposed, which could cause damage or otherwise disrupt the quality of the user's acoustical experience.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention.

What is claimed is:

1. An article of furniture comprising:

a cushioned seating portion;

a rigid panel configured adjacent to the cushioned seating portion;

a first plurality of exciters configured on a surface of the rigid panel for producing acoustic sound; and a controller communicatively coupled to the first plurality of exciters;

wherein the rigid panel wraps around a back portion the cushioned seating portion and at least partially along opposing sides of the cushioned seating portion;

wherein the cushioned seating portion is configured to sit on a base connected to the rigid panel at first and second connection points, further comprising a void configured between the first and second connection points separating a majority of the rigid panel from the base; and wherein at least two of the first plurality of exciters configured on opposing sides as an opposing pair.

2. The article of furniture of claim 1, wherein the rigid panel is configured to provide an arm rest, back rest and head rest.

3. The article of furniture of claim 1 further comprising:

a second plurality of exciters configured on a surface of the rigid panel, at least two of the second plurality of exciters configured as an opposing pair.

4. The article of furniture of claim 1, wherein a first side of the rigid panel comprises a first concave profile portion configured between a first and second convex profile portion, and a second side of the rigid panel comprising a second concave profile portion configured between a third and fourth convex profile portion.

5. The article of furniture of claim 4, wherein the first plurality of exciters comprises a first exciter configured at the first concave profile portion and a second exciter configured at the first convex profile portion.

6. The article of furniture of claim 4, wherein a second plurality of exciters comprises a third exciter configured at the second concave profile portion and a fourth exciter configured at the third convex profile portion.

7. The article of furniture of claim 1, wherein the first plurality of exciters are configured as opposing pairs on the rigid panel and spaced apart to produce an evenly distributed resonation.

8. The article of furniture of claim 1, wherein the first plurality of exciters includes four exciters configured as opposing pairs on the rigid panel.

9. The article of furniture of claim 1, wherein the rigid panel comprises an engineered rigid structure.

10. The article of furniture of claim 1, wherein the rigid panel comprises laminated wood or plywood.

11. The article of furniture of claim 1, wherein the article of furniture is a chair.

12. The article of furniture of claim 1, wherein the article of furniture is configured to seat at least one person.

* * * * *